US011248339B2

(12) United States Patent
Liu et al.

(10) Patent No.: US 11,248,339 B2
(45) Date of Patent: Feb. 15, 2022

(54) METHOD FOR MANUFACTURING STANDARD CARBON BLACK SOILED FABRICS

(71) Applicants: China Household Electric Appliance Research Institute, Beijing (CN); Beijing Institute of Fashion Technology, Beijing (CN)

(72) Inventors: Ting Liu, Beijing (CN); Ran Wang, Beijing (CN); Tongshuai Wang, Beijing (CN); Qing Pan, Beijing (CN); Yan Wang, Beijing (CN); Xiao Zhang, Beijing (CN); Xuejin Tang, Beijing (CN); Xiaoqian Wang, Beijing (CN); Wenhong Zhou, Beijing (CN); Xiaomin Li, Beijing (CN)

(73) Assignees: China Household Electric Appliance Research Instit, Beijing (CN); Beijing Institute of Fashion Technology, Beijing (CN)

( * ) Notice: Subject to any disclaimer, the term of this patent is extended or adjusted under 35 U.S.C. 154(b) by 5 days.

(21) Appl. No.: 16/946,003

(22) Filed: Jun. 2, 2020

(65) Prior Publication Data

US 2021/0010199 A1 Jan. 14, 2021

(30) Foreign Application Priority Data

Jul. 8, 2019 (CN) ..... 201910608496

(51) Int. Cl.

| | |
|---|---|
| ***D06M 11/74*** | (2006.01) |
| ***D06P 1/00*** | (2006.01) |
| ***D06P 5/00*** | (2006.01) |

(52) U.S. Cl.

CPC ..... *D06P 1/0076* (2013.01); *D06M 11/74* (2013.01); *D06P 5/001* (2013.01)

(58) Field of Classification Search

CPC ..... D06M 11/74; D06P 1/0076; D06P 5/001

See application file for complete search history.

(56) References Cited

FOREIGN PATENT DOCUMENTS

| | | |
|---|---|---|
| CN | 101718033 A | 6/2010 |
| CN | 103266500 A | 8/2013 |

OTHER PUBLICATIONS

Machine Translation of description section of CN 103266500 (Year: 2013).*

Panqing et al "Preliminary Study of New Carbon Black Contaminated Cloth Manufacturing Process" Household Appliance Technology, No. 10, 2015 pp. 44-45 published May 31, 2015 (Year: 2015).*

English translation of SIPO PRC second office action from CN 201910608477.0; dated Jul. 21, 2021 (Year: 2021).*

* cited by examiner

*Primary Examiner* — Nathan H Empie

(57) ABSTRACT

The application relates to the production of a soiled fabric, and more particularly to a method of manufacturing a standard carbon black soiled fabric for performance testing of washing machines. Water is adopted herein as the solvent to prepare a soil, which renders this method safe, environmentally friendly and economical. Moreover, this method introduces a fully-automatic continuous rolling-suction tentering and setting machine to control the pressure of the padder, the drying temperature, the air volume of the fan and the speed of chains, which reduces the manual intervention, achieving a highly-automatic printing and dyeing process. The reflectivity at four points on both sides of the standard carbon black soiled fabric according to the invention is 95% or more.

2 Claims, No Drawings

METHOD FOR MANUFACTURING STANDARD CARBON BLACK SOILED FABRICS

CROSS-REFERENCE TO RELATED APPLICATIONS

This application claims the benefit of priority from Chinese Patent Application No. 201910608496.3, filed on Jul. 8, 2019. The content of the aforementioned application, including any intervening amendments thereto, is incorporated herein by reference in its entirety.

TECHNICAL FIELD

The present disclosure relates to the manufacture of soiled fabrics, and more particularly to a method for manufacturing a standard carbon black soiled fabric for the testing of washing machines.

BACKGROUND

Standard soiled fabrics are generally used as the reference materials to test the cleaning efficiency of washing machines, and are also commonly used in the performance testing of washing machines worldwide. Currently, there are several methods developed for manufacturing standard soiled fabrics; however, these methods often involve some defects such as the lack of standardization on the treatment of original fabrics, soil formulation and soiling process, which will lead to unstable reflectivity in the original fabrics to be soiled and the finished product, high rejection rate and low yield, greatly affecting the accuracy and reproducibility of the performance testing for washing machines. Moreover, the existing manufacturing methods often adopt carbon tetrachloride as a dispersing medium in the production of a soil, which will cause serious pollution to the environment.

Therefore, there is an urgent need to develop a method of manufacturing a standard carbon black soiled fabric, which eliminates the pretreatment for the original fabrics and the use of carbon tetrachloride, and has a high degree of automation and high yield, to ensure the test accuracy, improve detection efficiency, avoid environmental pollution and reduce cost.

SUMMARY

An object of the invention is to provide a method of manufacturing a standard carbon black soiled fabric to overcome the defects in the prior art.

The technical solutions of the invention are described as follows.

The invention provides a method of manufacturing a standard carbon black soiled fabric, comprising:

(1) adding 2000 mL of water to a first beaker; adding 49-52 g of gum acacia powder; shearing the first reaction mixture by a shear emulsifying machine at 3000-5000 rpm for 15-20 min; adding 18-20 g of ink; shearing the first reaction mixture by the shear emulsifying machine at 3000-5000 rpm for 10-15 min; and then heating the first reaction mixture in a water bath to 90° C.;

(2) adding 1000 mL of water to a second beaker; heating the second beaker in the water bath to 90° C.; adding 14-16 g of lecithin; shearing the second reaction mixture by the shear emulsifying machine at 3000-5000 rpm for 10-15 min; adding 6-8 g of castor oil; and shearing the second reaction mixture by the shear emulsifying machine at 3000-5000 rpm for 10-20 min;

(3) slowly pouring the second reaction mixture obtained in step (2) into the first reaction mixture obtained in step (1) to produce a third reaction mixture; heating the third reaction mixture in the water bath at 90° C.; and shearing the third reaction mixture by the shear emulsifying machine at 3000-5000 rpm for 30-40 min to produce a stable carbon black soil;

(4) threading an original fabric to a padder of a continuous rolling-suction tentering and setting machine; turning on the setting machine; and feeding the carbon black soil prepared in step (3) to a liquid tank of the padder to print and dye the original fabric to produce a crude product;

(5) cutting the crude product using a laser cutter according to a standard size to produce the standard carbon black soiled fabric.

In an embodiment, in step (4), during the operation of the tentering and setting machine, a pressure of the padder is 19-21 psi; a chain retention time of the tentering and setting machine is 120-150 s; a rotating speed is 800-1000 rpm; a drying temperature is 110-150° C.; a chain spacing is 25-27 cm; and a difference between spacing between front ends of adjacent chains and spacing between rear ends of the adjacent chains is 0.4-0.6 cm.

The carbon black soil used in the method of the invention is prepared from gum acacia powder, lecithin and castor oil, where the gum acacia powder with a thickening effect is one of the key ingredients in the simulated water-soluble soil, which not only ensures the stability of the dispersion, but also forms a thin film with high viscosity and elasticity on the surface of the fabric to improve the adhesion of the soil to the fabric. The castor oil is one of the key ingredients in the simulated oil-soluble soil, but it is insoluble in the water and has a large viscosity, resulting in the formation of large oil droplets in water to cause adverse effects to the uniformity of the soiling. As an amphipathic material, the lecithin is suitable as a surfactant in an oil-containing mixture, so that it can allow the castor oil to disperse uniformly in an aqueous solution and ensure the stability of the dispersion, achieving the use of water as a solvent to obtain a stable carbon black soil.

The invention has the following beneficial effects as compared with the prior art.

The method provided herein adopts a fully-automatic continuous rolling-suction tentering and setting machine in the printing and dyeing, reducing the human intervention, lowering the cost and achieving the automatic operation. Moreover, water is used as the solvent in this method to prepare the soil, rendering the invention economical and environmentally friendly. The yield is 95% or more, and the reflectivity at four points on both sides of the prepared carbon black soiled fabric is 22-28%. It also has a desirable stability, significantly improving the testing efficiency.

DETAILED DESCRIPTION OF EMBODIMENTS

The invention will be described in detail below with reference to the embodiments to render the technical solutions of the invention better understood. It should be understood that these embodiments are not intended to limit the invention.

Example 1

Provided herein was a method of manufacturing a standard carbon black soiled fabric, which was specifically described as follows.

(1) 2000 mL of water was added to a 5 L beaker, to which 49 g of gum acacia powder was added. The first reaction mixture was sheared by a shear emulsifying machine at 3000 rpm for 15 min and added with 18 g of ink. Then the first reaction mixture was sheared by the shear emulsifying machine at 3000 rpm for 10 min and heated in a water bath at 90° C.

(2) 1000 mL of water was added to a 2 L beaker and heated to 90° C. in the water bath. 14 g of lecithin was added to the beaker, and the second reaction mixture was sheared by the shear emulsifying machine at 3000 rpm for 10 min, added with 6 g of castor oil and sheared again by the shear emulsifying machine at 3000 rpm for 10 min.

(3) The second reaction mixture obtained in step (2) was slowly poured into the first reaction mixture obtained in step (1) to produce a third reaction mixture. The third reaction mixture was heated in the water bath at 90° C. and sheared by the shear emulsifying machine at 3000 rpm for 30 min to produce a stable carbon black soil.

(4) An original fabric with a width of 30 cm was threaded to a padder of a continuous rolling-suction tentering and setting machine, and then the setting machine was operated, where a pressure of the padder was adjusted to 19 psi; a chain retention time of the tentering and setting machine was 150 s; a rotating speed was 800 rpm; a drying temperature was 110° C.; a spacing between adjacent chains was 26 cm at an input end and 26.5 cm at an output end. After the setting machine was operated for 10 min, the carbon black soil prepared in step (3) was fed into a liquid tank of the padder to print and dye the original fabric to produce a crude product.

(5) After the process of printing and dyeing was completed, the crude product was cut using a laser cutter to produce the standard carbon black soiled fabric with a size of 6×12 cm.

Example 2

Provided herein was a method of manufacturing a standard carbon black soiled fabric, which was specifically described as follows.

(1) 2000 mL of water was added to a 5 L beaker, to which 50 g of gum acacia powder was added. The first reaction mixture was sheared by a shear emulsifying machine at 4000 rpm for 18 min and added with 19 g of ink. Then the first reaction mixture was sheared by the shear emulsifying machine at 4000 rpm for 12 min and heated in a water bath at 90° C.

(2) 1000 mL of water was added to a 2 L beaker and heated to 90° C. in the water bath. 15 g of lecithin was added to the beaker, and the second reaction mixture was sheared by the shear emulsifying machine at 4000 rpm for 12 min, added with 7 g of castor oil and sheared again by the shear emulsifying machine at 4000 rpm for 15 min.

(3) The second reaction mixture obtained in step (2) was slowly poured into the first reaction mixture obtained in step (1) to produce a third reaction mixture. The third reaction mixture was heated in the water bath at 90° C. and sheared by the shear emulsifying machine at 4000 rpm for 35 min to produce a stable carbon black soil.

(4) An original fabric with a width of 30 cm was threaded to a padder of a continuous rolling-suction tentering and setting machine, and then the setting machine was operated, where a pressure of the padder was adjusted to 20 psi; a chain retention time of the tentering and setting machine was 135 s; a rotating speed was 900 rpm; a drying temperature was 135° C.; a spacing between adjacent chains was 26 cm at an input end and 26.5 cm at an output end. After the setting machine was operated for 10 min, the carbon black soil prepared in step (3) was fed into a liquid tank of the padder to print and dye the original fabric to produce a crude product.

(5) After the process of printing and dyeing was completed, the crude product was cut using a laser cutter to produce the standard carbon black soiled fabric with a size of 6×12 cm.

Example 3

Provided herein was a method of manufacturing a standard carbon black soiled fabric, which was specifically described as follows.

(1) 2000 mL of water was added to a 5 L beaker, to which 52 g of gum acacia powder was added. The first reaction mixture was sheared by a shear emulsifying machine at 5000 rpm for 20 min and added with 20 g of ink. Then the first reaction mixture was sheared by the shear emulsifying machine at 5000 rpm for 15 min and heated in a water bath at 90° C.

(2) 1000 mL of water was added to a 2 L beaker and heated to 90° C. in the water bath. 16 g of lecithin was added to the beaker, and the second reaction mixture was sheared by the shear emulsifying machine at 5000 rpm for 15 min, added with 8 g of castor oil and sheared again by the shear emulsifying machine at 5000 rpm for 20 min.

(3) The second reaction mixture obtained in step (2) was slowly poured into the first reaction mixture obtained in step (1) to produce a third reaction mixture. The third reaction mixture was heated in the water bath at 90° C. and sheared by the shear emulsifying machine at 5000 rpm for 40 min to produce a stable carbon black soil.

(4) An original fabric with a width of 30 cm was threaded to a padder of a continuous rolling-suction tentering and setting machine, and then the tentering and setting machine was operated, where a pressure of the padder was adjusted to 21 psi; a chain retention time of the tentering and setting machine was 120 s; a rotating speed was 1000 rpm; a drying temperature was 150° C.; a spacing between adjacent chains was 26 cm at an input end and 26.5 cm at an output end. After the setting machine was operated for 10 min, the carbon black soil prepared in step (3) was fed into a liquid tank of the padder to print and dye the original fabric to produce a crude product.

(5) After the process of printing and dyeing was completed, the crude product was cut using a laser cutter to produce the standard carbon black soiled fabric with a size of 6×12 cm.

Comparative Example 1

Provided herein was a method of manufacturing a standard carbon black soiled fabric, which was specifically described as follows.

(1) 2000 mL of water was added to a 5 L beaker, to which 10 g of gum acacia powder was added. The first reaction mixture was sheared by a shear emulsifying machine at 2000 rpm for 20 min and added with 9 g of ink. Then the first reaction mixture was sheared by the shear emulsifying machine at 2000 rpm for 10 min and heated in a water bath at 90° C.

(2) 1000 mL of water was added to a 2 L beaker and heated to 90° C. in the water bath. 2 g of lecithin was added to the beaker, and the second reaction mixture was sheared by the shear emulsifying machine at 2000 rpm for 10 min, added with 4 g of castor oil and sheared again by the shear emulsifying machine at 2000 rpm for 10 min.

(3) The second reaction mixture obtained in step (2) was slowly poured into the first reaction mixture obtained in step (1) to produce a third reaction mixture. The third reaction mixture was heated in the water bath at 90° C. and sheared by the shear emulsifying machine at 2000 rpm for 30 min to produce a stable carbon black soil.

(4) An original fabric with a width of 30 cm was threaded to a padder of a continuous rolling-suction tentering and setting machine, and then the setting machine was operated, where a pressure of the padder was adjusted to 18 psi; a chain retention time of the tentering and setting machine was 150 s; a rotating speed was 800 rpm; a drying temperature was 80° C.; a spacing between adjacent chains was 26 cm at an input end and 26.5 cm at an output end. After the setting machine was operated for 10 min, the carbon black soil prepared in step (3) was fed into a liquid tank of the padder to print and dye the original fabric to produce a crude product.

(5) After the process of printing and dyeing was completed, the crude product was cut using a laser cutter to produce the standard carbon black soiled fabric with a size of 6×12 cm.

Comparative Example 2

A soiled fabric manufactured by the process disclosed in a Chinese Patent Application No. 200910238114.9 was used as a comparison, which had a reflectivity of 20-30%. The process used herein involved complicated pretreatment for the original fabric, time-consuming operation and relatively low yield (85%).

TABLE 1

Reflectivity and yield of soiled fabrics produced in Examples 1-3 and Comparative Examples 1-2

| | Reflectivity | Yield |
|---|---|---|
| Example 1 | 25-28% | 98% |
| Example 2 | 24-26% | 98% |
| Example 3 | 22-25% | 97% |
| Comparative Example 1 | 34-37% | — |
| Comparative Example 2 | 20-30% | 85% |

Notes:

the reflectivity of each finished product is the arithmetic average value of the reflectivity of the four points on both sides of individual soiled fabrics measured by a whiteness meter (or a photoelectric reflectometer).

What is claimed is:

1. A method of manufacturing a standard carbon black soiled fabric, comprising:

(1) adding 2000 mL of water to a first beaker; adding 49-52 g of gum acacia powder to obtain a first reaction mixture; shearing the first reaction mixture by a shear emulsifying machine at 3000-5000 rpm for 15-20 min; adding 18-20 g of ink; shearing the first reaction mixture by the shear emulsifying machine at 3000-5000 rpm for 10-15 min; and then heating the first reaction mixture in a water bath to 90° C.;

(2) adding 1000 mL of water to a second beaker; heating the second beaker in the water bath to 90° C.; adding 14-16 g of lecithin to obtain a second reaction mixture; shearing the second reaction mixture by the shear emulsifying machine at 3000-5000 rpm for 10-15 min; adding 6-8 g of castor oil; and shearing the second reaction mixture by the shear emulsifying machine at 3000-5000 rpm for 10-20 min;

(3) slowly pouring the second reaction mixture obtained in step (2) into the first reaction mixture obtained in step (1) to produce a third reaction mixture; heating the third reaction mixture in the water bath at 90° C.; and shearing the third reaction mixture by the shear emulsifying machine at 3000-5000 rpm for 30-40 min to produce a stable carbon black soil;

(4) threading an original fabric to a padder of a continuous rolling-suction tentering and setting machine; turning on the setting machine; and feeding the carbon black soil prepared in step (3) to a liquid tank of the padder to print and dye the original fabric to produce a crude product; and (5) cutting the crude product using a laser cutter according to a standard size to produce the standard carbon black soiled fabric.

2. The method of claim 1, wherein in step (4), during the operation of the tentering and setting machine, a pressure of the padder is 19-21 psi; a chain retention time of the tentering and setting machine is 120-150 s; a rotating speed is 800-1000 rpm; a drying temperature is 110-150° C.; a chain spacing is 25-27 cm; and a difference between spacing between front ends of adjacent chains and spacing between rear ends of the adjacent chains is 0.4-0.6 cm.

* * * * *